US010730069B2

(12) United States Patent
Lussier et al.

(10) Patent No.: US 10,730,069 B2
(45) Date of Patent: Aug. 4, 2020

(54) REPLACEABLE CAULKING TIP

(71) Applicant: 730062 Ontario Inc., Scarborough (CA)

(72) Inventors: Arthur Lussier, Scarborough (CA); Jeffery Scott Andrew, Ajax (CA)

(73) Assignee: 730062 ONTARIO INC., Scarborough (CA)

( * ) Notice: Subject to any disclaimer, the term of this patent is extended or adjusted under 35 U.S.C. 154(b) by 0 days.

(21) Appl. No.: 14/783,386

(22) PCT Filed: Apr. 8, 2014

(86) PCT No.: PCT/CA2014/000316

§ 371 (c)(1),
(2) Date: Oct. 8, 2015

(87) PCT Pub. No.: WO2014/165965

PCT Pub. Date: Oct. 16, 2014

(65) Prior Publication Data

US 2016/0067736 A1 Mar. 10, 2016

Related U.S. Application Data

(60) Provisional application No. 61/809,551, filed on Apr. 8, 2013.

(51) Int. Cl.
*B05C 17/005* (2006.01)
*B05C 17/00* (2006.01)

(52) U.S. Cl.
CPC ..... *B05C 17/00506* (2013.01)

(58) Field of Classification Search
CPC ..... B05C 17/00513; B05C 17/00506; B05C 17/005; B05C 17/00573; B05C 17/00503; B65D 5/72; B65D 5/74; B65D 25/48; B65D 41/04; B65D 47/06; B65D 41/0428;

(Continued)

(56) References Cited

U.S. PATENT DOCUMENTS 1,296,045 A * 3/1919 Campbell ..... B65D 25/48 138/136
1,593,016 A * 7/1926 Campbell ..... B65D 25/48 138/135
2,543,909 A 3/1951 Hatheway, Jr.

(Continued)

*Primary Examiner* — Paul R Durand
*Assistant Examiner* — Andrew P Bainbridge

(57) ABSTRACT

Provided is a replaceable tip for communicating caulking from a reservoir of caulking. The reservoir is defined by a body having an opening and an external surface. The replaceable tip comprises: a) a flange operable to abut the external surface of the body; b) a conduit have a first portion and a second portion, the conduit extending through the flange and operable to enter the reservoir of caulking and operable to communicate caulking from inside the reservoir of caulking to outside the reservoir of caulking; and c) reversible sealing means for reversibly sealing the flange with the external surface of the body. When the reversible sealing means reversibly seals the flange with the external surface of the body, i) the flange prevents the first portion of the conduit from entering the reservoir; and ii) the second portion of the conduit is within the reservoir and aligns the conduit with the opening in the body thereby affecting communication with the reservoir.

15 Claims, 4 Drawing Sheets

Sect. c-c

(58) Field of Classification Search
CPC ..... B65D 41/0421; B65D 41/0435; B65D 47/142–143
USPC ..... 222/325–327, 526–537, 490–497, 391, 222/566–571
See application file for complete search history.

(56) References Cited

U.S. PATENT DOCUMENTS 2,570,426 A 10/1951 Cassidy
2,833,450 A * 5/1958 Sherbondy ..... B05C 17/00516 222/327
2,953,285 A * 9/1960 McKelvey ..... B05C 17/00516 222/325
2,981,449 A * 4/1961 Perkins ..... B05C 17/00516 222/541.2
3,091,373 A 5/1963 Kirschbaum
3,093,274 A * 6/1963 Galbierz ..... B65D 25/42 222/325
3,266,682 A 8/1966 Schultz
3,343,724 A 9/1967 Malpas
4,073,398 A * 2/1978 Schultz ..... B65D 45/32 215/253
4,267,945 A 5/1981 Maynard, Jr.
4,284,213 A 8/1981 Lee
4,342,408 A * 8/1982 Boring ..... B65D 25/42 220/378
4,356,935 A * 11/1982 Kamin ..... A47G 19/183 206/384
4,382,530 A * 5/1983 Calisto ..... B65D 25/48 222/326
4,461,454 A * 7/1984 Vadnais ..... B05C 17/002 222/521
5,017,113 A * 5/1991 Heaton ..... B05C 17/00516 222/327
5,104,013 A * 4/1992 Hawley ..... B65D 35/38 222/566
5,137,184 A * 8/1992 Jackson ..... B05C 17/00506 222/327
5,248,071 A * 9/1993 Ray ..... B65D 47/122 222/566
5,249,716 A * 10/1993 O'Sullivan ..... B05C 17/00516 222/326
5,297,697 A * 3/1994 Boring ..... B05C 17/00516 137/68.23
5,560,521 A * 10/1996 Boring ..... B05C 17/01 222/327
5,833,099 A * 11/1998 Boaz ..... B05C 17/00516 222/568
5,901,887 A * 5/1999 Wark ..... B67D 7/005 222/527
6,076,712 A * 6/2000 Esber ..... B05C 17/00516 222/527
6,179,506 B1 * 1/2001 Dewberry ..... B05C 17/00516 222/567
6,398,085 B2 * 6/2002 Foster ..... B05C 17/00516 220/796
6,578,737 B2 * 6/2003 Jackman ..... B05C 17/00586 222/1
6,610,034 B1 * 8/2003 Fischer ..... A61J 1/2096 604/235
7,014,079 B2 * 3/2006 Swann ..... B05C 17/00516 222/326
7,445,135 B2 * 11/2008 Miyata ..... B05C 17/00513 222/105
7,959,038 B2 * 6/2011 de Oliveira ..... B65D 83/0005 222/326
8,177,768 B2 * 5/2012 Leinsing ..... A61J 1/2089 604/411
D677,535 S * 3/2013 Scott ..... D8/14.1
8,430,276 B2 * 4/2013 Longo, II ..... B65D 83/0005 222/1
8,561,850 B1 * 10/2013 Dawson ..... B05C 17/00503 222/191
8,991,662 B2 * 3/2015 Milan ..... B05C 17/00506 222/327
9,067,711 B2 * 6/2015 Melia ..... B05C 17/00583
9,943,876 B2 * 4/2018 Haynes ..... B65D 83/0022
2005/0029314 A1 * 2/2005 Williams ..... B05C 17/00516 222/527
2005/0274749 A1 * 12/2005 Labossiere ..... B05C 17/00516 222/527
2006/0163293 A1 * 7/2006 Peay ..... B05C 17/00509 222/611.1
2007/0017938 A1 * 1/2007 Thompson ..... B05C 17/00516 222/527
2007/0095865 A1 * 5/2007 Chick ..... B05C 17/00513 222/568
2007/0226968 A1 * 10/2007 Valenzuela ..... A43B 1/0027 24/715.4
2013/0112720 A1 * 5/2013 Cross ..... B65D 47/065 222/567
2013/0126558 A1 * 5/2013 Schneider ..... B65D 47/06 222/330
2015/0158050 A1 * 6/2015 Atwell ..... B05C 17/00516 222/420
2016/0067736 A1 * 3/2016 Lussier ..... B05C 17/0052 222/562

* cited by examiner

Sect. c-c

REPLACEABLE CAULKING TIP

CROSS-REFERENCE TO RELATED APPLICATIONS

This application claims priority benefit to U.S. provisional application Ser. No. 61/809,551, filed on Apr. 8, 2013 which is hereby incorporated by reference in its entirety and is the national stage of PCT/CA2014/000316, filed on Apr. 8, 2014.

TECHNICAL FIELD

This invention relates to the field of construction and more particularly to a replaceable nozzle for dispensing caulking.

BACKGROUND

US 2004/035888 discloses a replacement caulking tube nozzle, having a nozzle portion, integrally formed with a base, having a connecting lip extending downwardly therefrom, the lip intended for inserting within the end of a cut or severed caulking tube, in order to eliminate any of the hardened caulk, from plugging up the tube for further usage. Where the lip of the replacement nozzle is applied internally of the tube, for the replacement nozzle, it may include a flange that biases against the end of the tube to act as a further seal against leakage of caulking material from the tube upon the application of pressure through operation of the caulking gun U.S. Pat. No. 4,461,454 discloses a two piece valve accessory for common caulking tubes or cartridges insertable in caulking guns. The valve permits resealing of the cartridge nozzle, snout or applicator tip without hardening or significant wastage of the material therein and permits increased control of the flow rate of material from the cartridge. The valve is adjustable from fully open to closed position and includes a separate sealed or dome extended position wherein the residue from the applicator tip of the valve is expelled. The valve barrel includes an integral piercing edge to break the cartridge seal as the valve is inserted into the applicator tip of the cartridge. The barrel is sized and ribbed for an interference non-rotatable fit within the applicator tip. The valve cap is fully rotatable on the barrel and includes a beveled tip to direct material in any radial direction relative to the caulking gun handle. In use the valve is opened and caused to remain open by pressure applied to the cartridge by the caulking gun plunger. The valve is closed or fully closed and sealed manually after release of the pressure on the material in the cartridge.

U.S. Pat. No. 7,014,079 discloses a universal replacement tip for a caulking tube designed to replace an original caulking tube tip after the tip has been used or in the event the user wishes to use a tip that produces a different shape and/or thickness of caulking bead without the need or special adapters, flanges or modification to the dispensing gun in which the caulking tube is used. The caulking tube replacement tip includes a flange at its base with an adhesive material attached to the bottom of the flange. The base is placed over the remains of the original caulking tube tip after it has been cut off and is secured to the top of the caulking tube with the adhesive material. The caulking tube replacement tip tapers up from the base to a sealed tip which can be any shape and size including round, oval, rectangular, square and star-shaped.

SUMMARY

This invention is based, at least in part, on the understanding that the dispensing nozzle portion of a caulking tube may be easily removed without removing any other portion of the caulking tube, and in so doing the hardened caulking that may be preventing access to the fresh caulking is also removed. The dispensing nozzle to be removed may be from a caulking tube of any standard size, including, but not limited to, a small standard size or a large commercial size. By removing the hardened caulking in this manner, 1) the block is removed, as opposed to pushing it back into the reservoir of caulking where it is able to interfere with the flow of caulking from the reservoir again later, and 2) the invention is able to be used with any standard caulking tube.

In illustrative embodiments, there is provided a replaceable tip for communicating caulking from a reservoir of caulking, the reservoir defined by a body having an opening and an external surface, the replaceable tip comprising: a) a flange operable to abut the external surface of the body; b) a conduit have a first portion and a second portion, the conduit extending through the flange and operable to enter the reservoir of caulking and operable to communicate caulking from inside the reservoir of caulking to outside the reservoir of caulking; and c) reversible sealing means for reversibly sealing the flange with the external surface of the body, wherein when the reversible sealing means reversibly seals the flange with the external surface of the body: the flange prevents the first portion of the conduit from entering the reservoir; and the second portion of the conduit is within the reservoir and aligns the conduit with the opening in the body thereby affecting communication with the reservoir.

In illustrative embodiments, there is provided a replaceable tip described herein wherein the second portion comprises at least one slit.

In illustrative embodiments, there is provided a replaceable tip described herein wherein the at least one slit is at least four slits.

In illustrative embodiments, there is provided a replaceable tip described herein wherein the flange is the reversible sealing means and the tip is operable to be frictionally engaged with the body.

In illustrative embodiments, there is provided a replaceable tip described herein wherein the reversible sealing means is selected from at least one of the group consisting of: a screw, a caulking gun, and an adhesive.

In illustrative embodiments, there is provided a replaceable tip described herein wherein the reversible sealing means is selected from at least one of the group consisting of: glue, tape, a magnet, and a caulking gun.

In illustrative embodiments, there is provided a replaceable tip described herein wherein the second portion of the conduit is threadably engageable with the body and the second portion of the conduit is the sealing means.

In illustrative embodiments, there is provided a replaceable tip described herein wherein the tip is flexible.

In illustrative embodiments, there is provided a replaceable tip described herein wherein the tip is rigid.

In illustrative embodiments, there is provided a replaceable tip described herein wherein the length of the tip is from about 2 inches to about 10 inches.

In illustrative embodiments, there is provided a replaceable tip described herein wherein the length of the tip is from about 2 inches to about 6 inches.

In illustrative embodiments, there is provided a replaceable tip described herein wherein the length of the tip is from about 2.85 inches to about 3.25 inches.

In illustrative embodiments, there is provided a replaceable tip described herein wherein the length of the tip is about 3 inches.

In illustrative embodiments, there is provided a replaceable tip described herein wherein the sealing means further comprises a gasket.

In illustrative embodiments, there is provided a replaceable tip described herein further comprising an attachment means for attaching an auxiliary device to the tip.

In illustrative embodiments, there is provided a replaceable tip described herein wherein the attachment means is selected from the group consisting of: ribbing and a screw thread on the first portion of the conduit.

In illustrative embodiments, there is provided a replaceable tip described herein wherein the attachment means comprises a holder threadably engageable with the first portion of the conduit, the holder operable to hold the auxiliary device.

In illustrative embodiments, there is provided a replaceable tip described herein wherein the auxiliary device is a cap.

In illustrative embodiments, there is provided a replaceable tip described herein wherein the auxiliary device is a second conduit.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
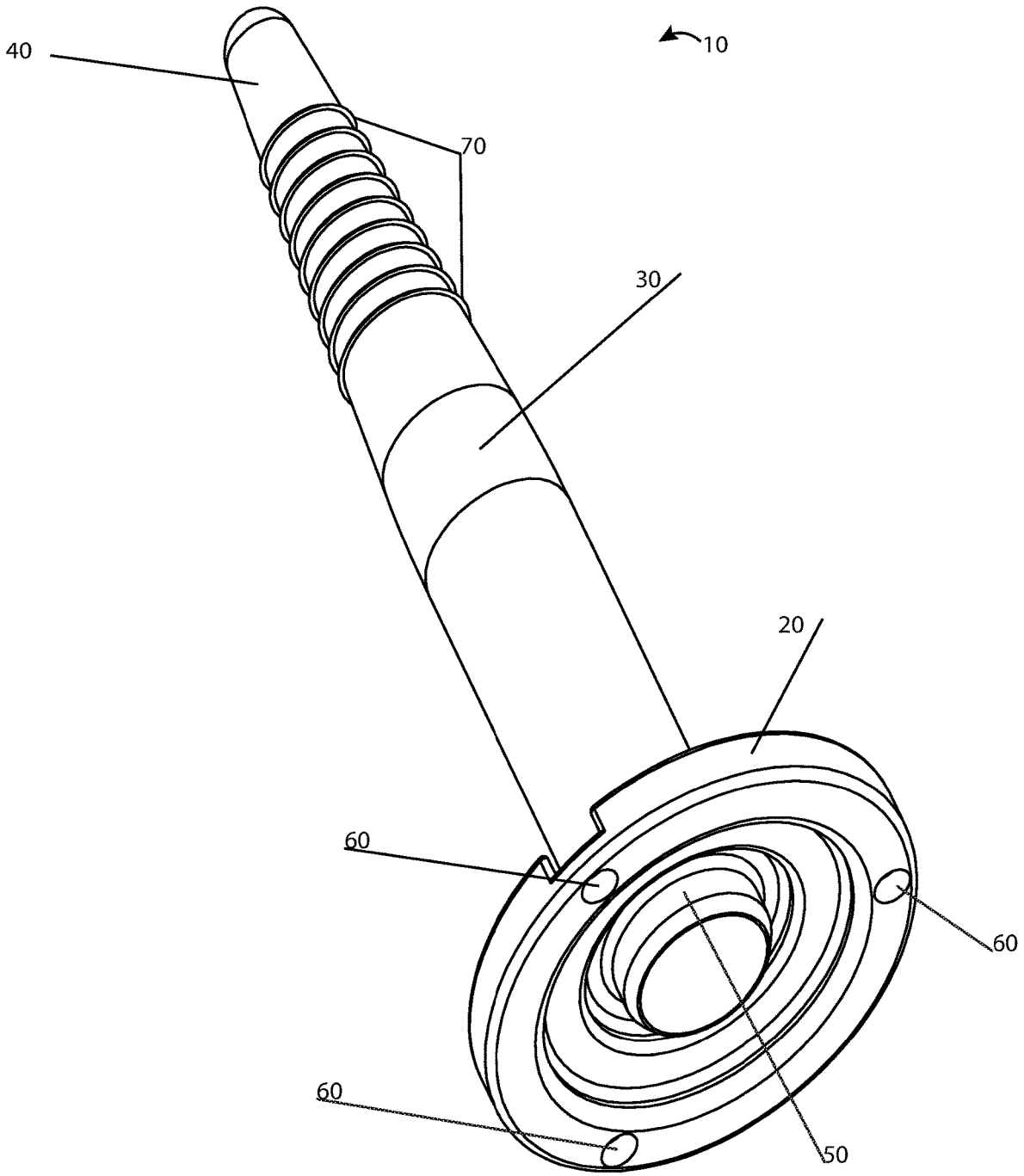
FIG. 1 is an isometric view of an embodiment of the invention.
Figure 2:
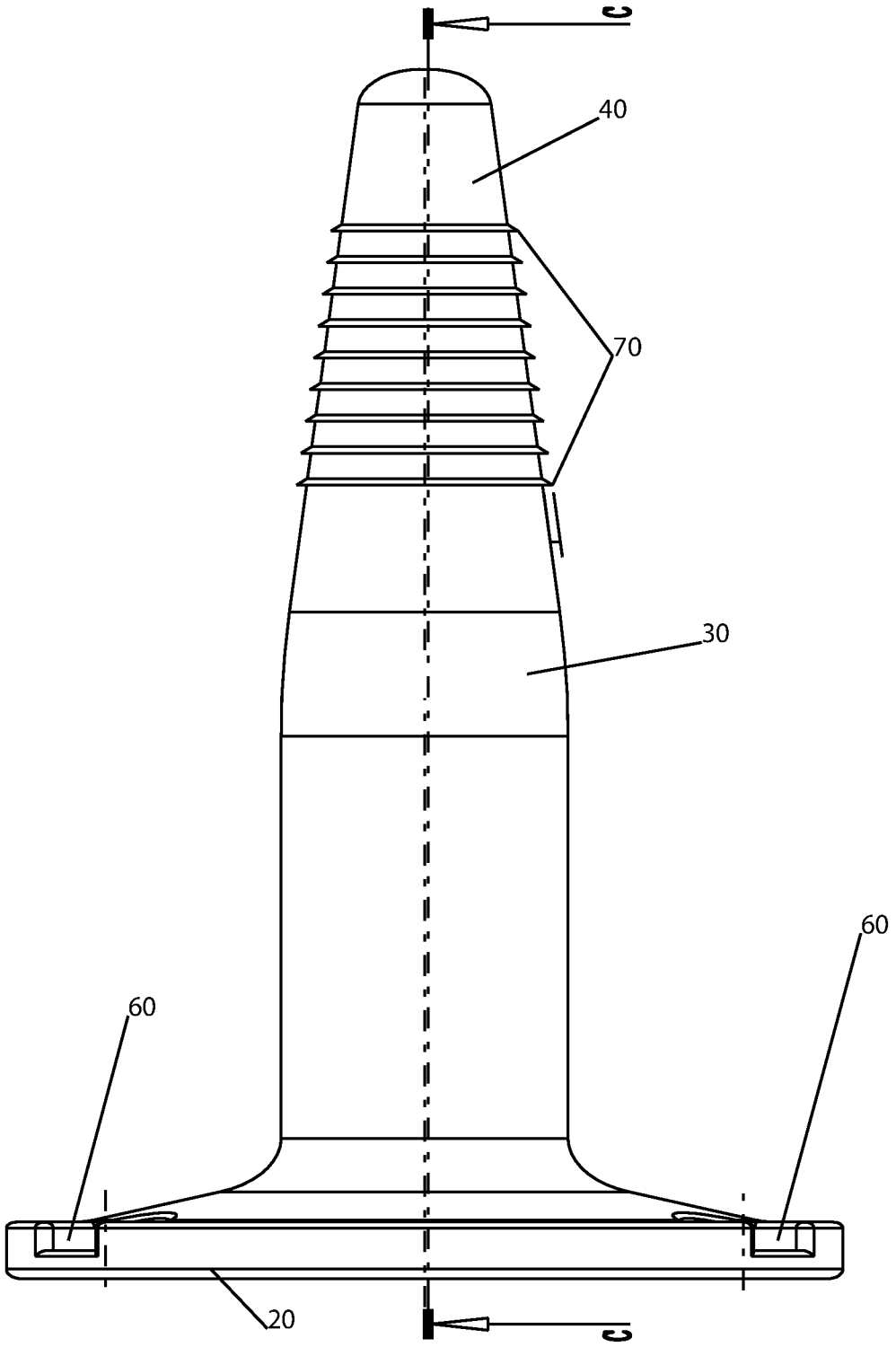
FIG. 2 is a side view of an embodiment of the invention.
Figure 3:
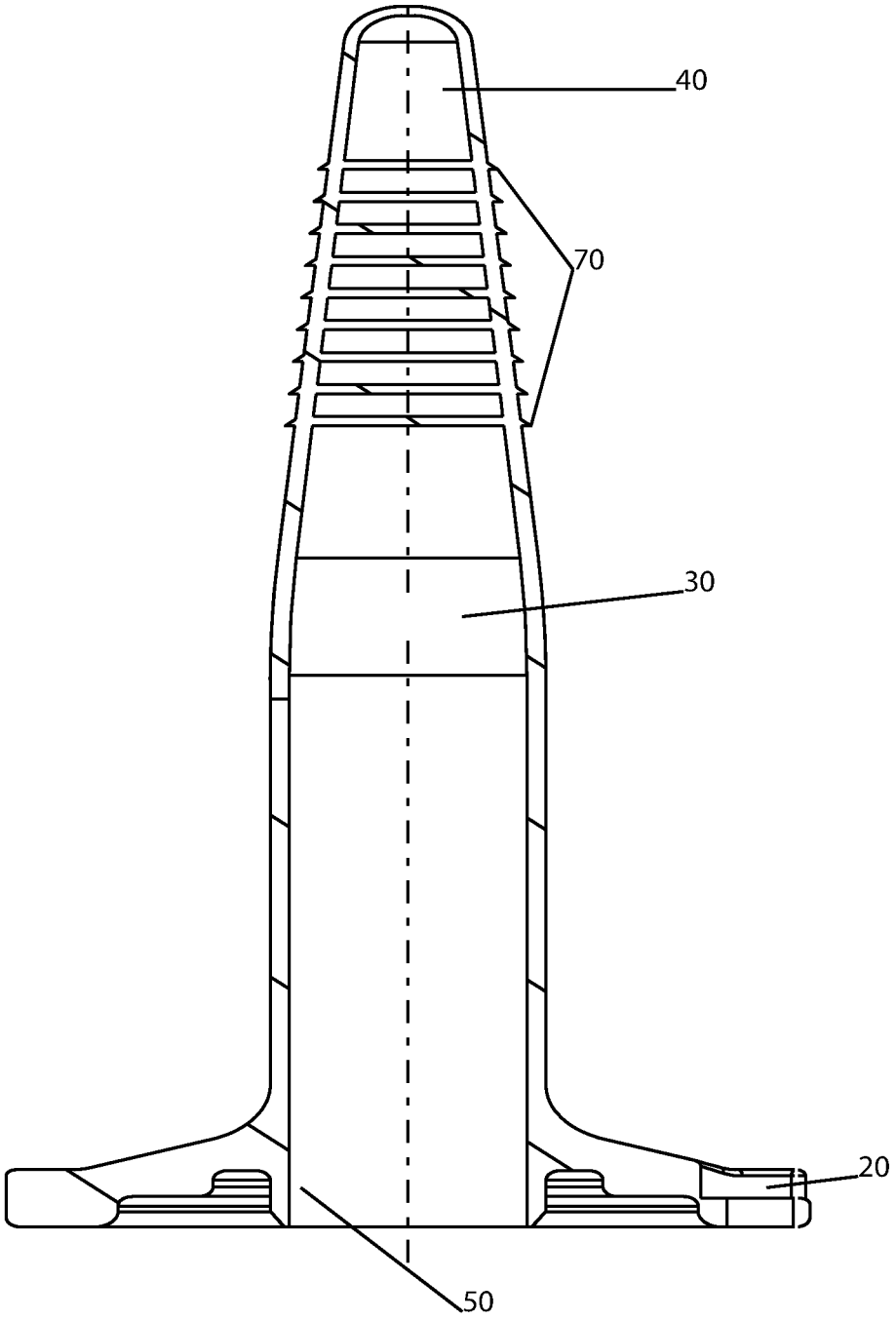
FIG. 3 is a cross-sectional view of the embodiment of the invention as set out in FIG. 2.
Figure 4:
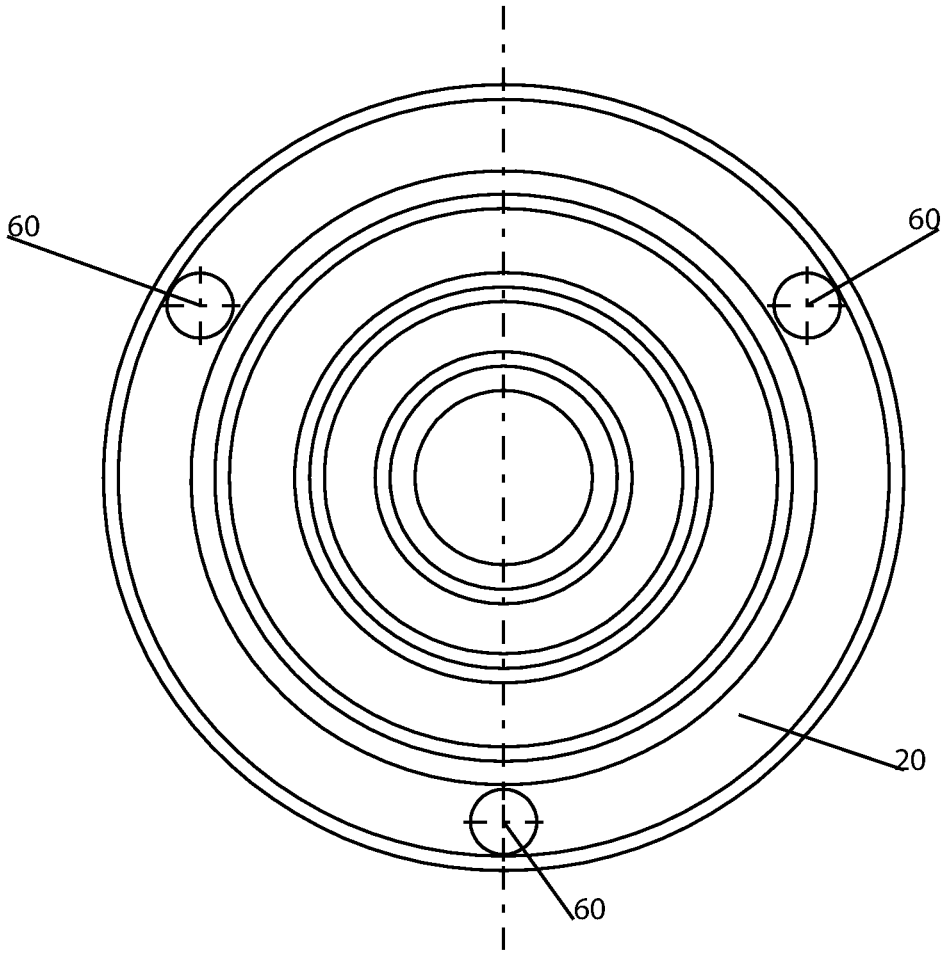
FIG. 4 is a bottom view of an embodiment of the invention.

Referring to FIG. 1, an apparatus according to a first embodiment of the invention is shown generally at 10. A flange 20 is operable to abut an external surface of a caulking tube and/or can. The external surface of the caulking tube to which the flange 20 is operable to abut is the surface on the caulking tube which defines an opening in the caulking tube so as to permit caulking to be expelled from a reservoir defined by the caulking tube. The flange 20 has a width that is larger than the width of the opening defined by the external surface and consequently the flange 20 is able to abut the external surface of the caulking tube such that it is positioned close to and/or at the opening defined by the external surface when the flange 20 is abutting the external surface of the caulking tube. The flange 20 prevents the invention from completely entering the reservoir of caulking. In many embodiments the flange 20 is generally circular and has a diameter that fits into the diameter of the generally circular area of the caulking tube that is slightly recessed and comprises the opening. The flange 20 is not operable to overlap the entire caulking tube and does not act as a skirt or sleeve which fits over the caulking tube in its entirety, but rather rests against the caulking tube and often is within a recess defined by the edges of the caulking tube.

A conduit 30 has a first portion 40 and a second portion 50. The conduit 30 extends through the flange 20 and the second portion 50 is operable to enter the reservoir of caulking. The conduit 30 is operable to communicate caulking from inside the reservoir of caulking to outside the reservoir of caulking, or said differently, from the reservoir of caulking to an operator's desired location. This is achieved by the operator using the caulking tube in a usual manner, as understood by a person of skill in the art, and the caulking is then forced to flow from the reservoir of caulking into the conduit 30 at the second portion 50. Then, the caulking continues to flow through the entire conduit 30 and exit the conduit 30 via the first portion 40 where the caulking is then dispensed to the operator's desired location.

The invention also comprises a sealing means 60 which is operable to maintain the second portion 50 of the conduit 30 in the reservoir of caulking. The reversible sealing means 60 for reversibly sealing the flange 20 with the external surface of the caulking tube is also shown in FIG. 1. In FIG. 1, the sealing means is a set of three holes which are operable to receive a screw or nail which, when present are able to seal the flange 20 to the external surface of the caulking tube. The sealing means 60 does not need to be holes operable to receive a screw or nail and may be another method or structure for sealing the embodiment of the invention to the caulking tube. The sealing means 60 may be, but is not limited to, a screw, a nail, a tack, a staple, an adhesive (e.g. tape, glue, and/or Velcro™), a caulking gun, a finger of an operator, a tapered end of the second portion 50 of conduit 30 and/or a magnet. The sealing means 60 may be one or more sealing means. Often the sealing means is the flange 20 abutted against the external surface of the caulking tube and held in place frictionally, for example with the fingers of the operator or by an overlapping flange, such as the one on a typical caulking gun. The overlapping flange or finger holds the flange 20 on the external surface of the caulking tube. The sealing means is often improved by use of a gasket to prevent leakage of caulking during operation of the invention. The gasket may be fitted onto an embodiment of the invention that is suitable for the particular type of sealing means in the embodiments. In some particular embodiments, the gasket is an o-ring style gasket that is fitted around an outside surface of the second portion 50 of conduit 30.

When the invention is in operation, the second portion 50 of the conduit 30 is within the reservoir of caulking and the second portion 50 aligns the conduit 30 with the opening in the body. This alignment, in combination with the sealing means 60, permits communication of caulking from the reservoir to the operator's desired location. The amount that the second portion 50 of conduit 30 protrudes into the reservoir of caulking may have an effect on the functioning of the invention. In particular, if the second portion 50 of the conduit 30 is too long, this may interfere with normal operation of a caulking tube with a caulking gun, including, but not limited to, undesirable dispensing of the caulking from the first portion 40 of the conduit 30 when the reservoir of caulking is of a size such that the second portion 50 of conduit 30 is as long or close to as long as the reservoir of caulking is deep. It is therefore possible to optimize performance of embodiments of the invention by ensuring that the length of the second portion 50 of conduit 30 that is within the reservoir of caulking is kept to only enough length to engage the reservoir (via protrusion therein) and to align the embodiment of the invention and not more than is required for that. Functional embodiments of the invention may also include embodiments in which the second portion 50 of conduit 30 is long enough to protrude significantly into the reservoir, and there are specific uses for such embodiments, but for typical caulking applications the length of the second portion 50 of conduit 30 is often enough to permit engagement with the reservoir of caulking via a small protrusion into the reservoir of caulking.

In some embodiments, the second portion 50 of conduit 30 comprises at least one slit extending from an end of the conduit 30 towards the flange 20. The at least one slit extends such that when the flange 20 abuts the external surface of the caulking tube, the entirety of each of the at least one slits is entirely within the reservoir. Notwithstanding that the at least one slit may be any length shorter, the length of the at least one slit is often as long as the second portion 50 of the conduit 30 while maintaining the configuration that when the flange 20 abuts the external surface of the caulking tube, the entirety of each of the at least one slits is entirely within the reservoir. Each of the at least one slits may be of different lengths. Often the at least one slit is four slits spaced approximately an even distance apart from each other about the second portion 50 of the conduit 30.

In some embodiments of the invention, the replaceable tip is operable to be threadably engaged with the caulking tube. Such threadable engagement is in a manner that ensures that the portion of the caulking tube to which the embodiment is threadably engaged is not able to be blocked by hardened caulking because that portion of the caulking tube is prevented from coming into contact with caulking by the embodiment of the invention. If this type of threadable engagement is not maintained, then it is not possible to remove the blockage due to hardened caulking by simply replacing the tip or nozzle. It is also possible to use such a threadable engagement as the sealing means 60. An example of such threadable engagement is, but is not limited to, an embodiment of the invention having a thread on the outside of the second portion 50 of the conduit 30.

Some embodiments of the present invention comprise a first portion 40 of the conduit 30 that is flexible. Some embodiments of the invention comprise a first portion 40 of the conduit 30 that is rigid. The flexibility and/or rigidity of the first portion 40 of the conduit 30 may be selected depending on the nature of the caulking operation to be completed. Further, the second portion 50 of the conduit 30 may be flexible or rigid also. In some embodiments, a flexible second portion 50 of the conduit 30 may aid attachment of the tip to the caulking tube. For example, if the is some limited flex in a tapered second portion 50 of the conduit 30, then it may be possible to accommodate openings of different sizes more easily and with better sealing. In this regard, the at least one slit provides rigid materials, which rigid materials may be better suited for alignment of the conduit 30 with the opening in the body, with some flex such that it may be easier to insert the second portion 50 into the opening in the body. The at least one slit may permit a temporary deformation of the second portion 50 such that the perimeter or circumference of the second portion 50 is operable to be reduced. Such a reduced perimeter or circumference may aid insertion of the second portion 50 into the opening of the body. Arranging multiple slits such that a generally rigid second portion 50 is provided, while the slits permit some limited deformation of the second portion 50 is often useful. Often four slits are provided where the second portion 50 comprises four quarters, each quarter having limited movement relative to each other. On the other hand, a rigid second portion 50 of the conduit 30 may be better suited to a threadably engageable second portion 50 of the conduit 30. The relative flexibility of the first portion 40 of the conduit 30 and the second portion 50 of the conduit 30 may be the same or different and may be selected based on the desired operation of the tip.

The conduit 30 may also be of varying lengths. In many embodiments, the conduit 30 may be from about 2 inches to about 10 inches (or about 5 cm to about 25.5 cm). In many embodiments, the conduit 30 may be from about 2 inches to about 6 inches (or about 5 cm to about 15.25 cm). In some embodiments the conduit 30 may be about 2.85 inches to about 3.25 inches (or about 7.25 cm to about 8.25 cm) and often is about 3 inches (or about 7.5 cm).

In many embodiments, the length of the first portion 40 of the conduit 30 may be from about 1.875 inches to about 9.875 inches (or about 4.5 cm to about 25 cm). In many embodiments, length of the first portion 40 of the conduit 30 may be from 1.875 inches to about 5.875 (or about 4.5 cm to about 15 cm). In some embodiments, length of the first portion 40 of the conduit 30 may be about 2.875 inches to about 4.875 inches (or about 7.5 cm to about 12.5 cm).

In many embodiments, the length of the second portion 50 of the conduit 30 may be from 0.125 inches to about 8.125 inches (or about 0.25 cm to about 20.5 cm). In many embodiments, length of the second portion 50 of the conduit 30 may be from about 0.125 inches to about 4.125 inches (or about 0.25 cm to about 10.5 cm). In some embodiments, length of the second portion 50 of the conduit 30 may be from about 0.125 inches to about 3.125 inches (or about 0.25 cm to about 8 cm). In embodiments comprising at least one slit, the at least one slit is often the same length as the second portion 50 or slightly shorter than the length of the second portion 50. The length of the slit may also be significantly shorter than the second portion 50.

In some embodiments, the first portion 40 of the conduit 30 comprises an attachment means that is operable to attach to an auxiliary device. The attachment means, may be, but is not limited to, a tapered shape, ribbing and/or other frictional attachment means, and/or a thread which is threadable engageable with another thread on the auxiliary device. In other embodiments still, the attachment means may be a holder threadably engageable with the first portion 40 of the conduit 30. The holder is operable to hold the auxiliary device. An example of ribbing may be seen in the Figures as indicated by the number 70 in the Figures.

The auxiliary device may be any device that an operator may find desirable or useful to dispense caulking or to store caulking. For example, the auxiliary device may be, but is not limited to, a cap to seal the reservoir from the air thereby maintaining the caulking as fresh. The auxiliary device may be, but is not limited to, a second conduit, which second conduit may have an extra length in order to aid reach to a difficult area. The second conduit may have a particular shape so as to be able to dispense a particular kind of desired caulking bead. The second conduit may be of a different flexibility and/or rigidity to the replaceable tip.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. Furthermore, numeric ranges are provided so that the range of values is recited in addition to the individual values within the recited range being specifically recited in the absence of the range. The word "comprising" is used herein as an open-ended term, substantially equivalent to the phrase "including, but not limited to", and the word "comprises"

has a corresponding meaning. As used herein, the singular forms "a", "an" and "the" include plural references unless the context clearly dictates otherwise. Thus, for example, reference to "a thing" includes more than one such thing. Citation of references herein is not an admission that such references are prior art to the present invention. Furthermore, material appearing in the background section of the specification is not an admission that such material is prior art to the invention. Any priority document(s) are incorporated herein by reference as if each individual priority document were specifically and individually indicated to be incorporated by reference herein and as though fully set forth herein. The invention includes all embodiments and variations substantially as hereinbefore described and with reference to the examples and drawings.

What is claimed is:

1. A replaceable tip for communicating caulking from a reservoir of caulking, the reservoir defined by a body having an opening and an external surface, the replaceable tip comprising:

a) a flange operable to abut the external surface of the body;

b) a conduit having a first portion and a second portion, the conduit extending through the flange and operable to enter the reservoir of caulking and operable to communicate caulking from inside the reservoir of caulking to outside the reservoir of caulking; and c) reversible sealing means for reversibly sealing the flange with the external surface of the body, wherein the second portion and the flange each have an end lying on the same plane; and wherein the replaceable tip is a one-piece replaceable tip; and wherein when the reversible sealing means reversibly seals the flange with the external surface of the body:

the flange prevents the first portion of the conduit from entering the reservoir; and the second portion of the conduit is within the reservoir and aligns the conduit with the opening in the body thereby affecting communication with the reservoir.

2. The replaceable tip of claim 1 wherein the flange is the reversible sealing means and the tip is operable to be frictionally engaged with the body.

3. The replaceable tip of claim 1 wherein the reversible sealing means is selected from at least one of the group consisting of: a screw, a caulking gun, and an adhesive.

4. The replaceable tip of claim 1 wherein the reversible sealing means is selected from at least one of the group consisting of: glue, tape, a magnet, and a caulking gun.

5. The replaceable tip of claim 1 wherein the second portion of the conduit is threadably engageable with the body and the second portion of the conduit is the sealing means.

6. The replaceable tip of claim 1 wherein the length of the tip is from about 2 inches to about 10 inches.

7. The replaceable tip of claim 1 wherein the length of the tip is from about 2 inches to about 6 inches.

8. The replaceable tip of claim 1 wherein the length of the tip is from about 2.85 inches to about 3.25 inches.

9. The replaceable tip of claim 1 wherein the length of the tip is about 3 inches.

10. The replaceable tip of claim 1 wherein the sealing means further comprises a gasket.

11. The replaceable tip of claim 1 further comprising an attachment means for attaching an auxiliary device to the tip.

12. The replaceable tip of claim 11 wherein the attachment means is selected from the group consisting of: ribbing and a screw thread on the first portion of the conduit.

13. The replaceable tip of claim 11 wherein the attachment means comprises a holder threadably engageable with the first portion of the conduit, the holder operable to hold the auxiliary device.

14. The replaceable tip of claim 11 wherein the auxiliary device is a cap.

15. The replaceable tip of claim 11 wherein the auxiliary device is a second conduit.

* * * * *